US005444517A

United States Patent [19]

Nagashima

[11] Patent Number: 5,444,517

[45] Date of Patent: Aug. 22, 1995

[54] MANAGEMENT SYSTEM FOR CONTROLLING OPERATION OF AN IMAGE PROCESSING APPARATUS

[75] Inventor: Nao Nagashima, Yokohama, Japan

[73] Assignee: Canon Kabushiki Kaisha, Tokyo, Japan

[21] Appl. No.: 113,255

[22] Filed: Aug. 30, 1993

[30] Foreign Application Priority Data

Sep. 1, 1992 [JP] Japan ..... 4-233297

[51] Int. Cl.[6] ..... G03G 15/00

[52] U.S. Cl. ..... 355/201; 340/825.31

[58] Field of Search ..... 355/200, 201, 202, 204, 355/206; 364/138; 358/434; 340/825.06, 825.31, 825.32, 825.34

[56] References Cited

U.S. PATENT DOCUMENTS 4,494,114 1/1985 Kaish ..... 340/825.31
5,214,772 5/1993 Weinberger et al. ..... 355/202 X
5,282,127 1/1994 Mii ..... 355/206 X

FOREIGN PATENT DOCUMENTS 4-67162 3/1992 Japan ..... 355/200

OTHER PUBLICATIONS

*IBM Technical Disclosure Bulletin,* vol. 25, No. 2, Jul. 1982, "Copier Power Control System", Hyde et al., 355-201.

*Primary Examiner*—Joan H. Pendegrass
*Attorney, Agent, or Firm*—Fitzpatrick, Cella, Harper & Scinto

[57] ABSTRACT

A copier is capable of being managed more effectively by improving a conventional management system that utilizes a communication line. The copier accesses a computer when it is started and transfers its machine ID, which specifies the particular copier, as well as a line ID of the communication channel specifying the place of installation to the computer. When the computer has been accessed, the communication channel is specified from the line ID and then the copier is accessed via the communication channel. In the copier disclosed, contact from the computer is verified after transfer of the machine ID and line ID, and the functions of the copier are allowed to be used after verification of the IDs. Thus, use of the copier is restricted until contact from the computer is verified.

19 Claims, 10 Drawing Sheets

FIG. 10

| CNO SIGNAL | PRINT OUTPUT |
|---|---|
| 0 | MAGENTA (M) |
| 1 | CYAN (C) |
| 2 | YELLOW (Y) |
| 3 | BLACK (Bk) |

MANAGEMENT SYSTEM FOR CONTROLLING OPERATION OF AN IMAGE PROCESSING APPARATUS

BACKGROUND OF THE INVENTION

This invention relates to an image processing apparatus, such as an image processing apparatus having an internal function for communicating with external equipment.

Control of a device-such as a copier can be managed in a number of ways. For example, (1) the user of the device is specified using a card such as a control card or IC card mainly for the purpose of calculating a user fee for a copier; (2) a control key is provided for limiting use solely to specific individuals, as in the case of a color copier; and (3) a system is established in which the device is connected to a service location via a communication line so that information may be concentrated and managed at the service location mainly for the purpose of improving the servicing of the device and collecting billing data.

With regard to devices such as color copiers for which there is the danger of improper use, management stricter than that for ordinary copiers currently is being carried out through an operation such as customer control performed at the shop level.

In recent years, the widespread use of high-resolution color copiers has been accompanied by conspicuous examples of improper use in which management of the aforementioned kind is evaded. A more effective method of managing devices of the aforementioned type is desired.

SUMMARY OF THE INVENTION

Accordingly, an object of the present invention is to provide an image processing apparatus in which more effective management of the apparatus is made possible by improving a management system that utilizes a communication line.

According to the present invention, the foregoing object is attained by providing an image processing apparatus in which prescribed information is transmitted to an external device and it is verified that the transmission has been performed normally. Use of at least some of the functions possessed by the image processing apparatus is restricted until it is verified that the transmission has been performed normally.

If, say, a communication line is used for the transmission of this information, an arrangement can be adopted in which normal execution of the transmission is judged by verifying the connection of the line. This makes it possible to improve the management system with facility.

Further, in accordance with the present invention, there is provided an image processing apparatus in which identification information for identifying the image processing apparatus is transmitted to an external device and a response from the external device, which is based upon the transmitted identification information, is received. Use of at least some of the functions possessed by the apparatus is limited restricted until the response is received. With an arrangement of this kind, connection to the computer of a service location or the like is made more reliable and management can be performed more strictly.

A computer system provided by the present invention is connected to at least one image processing apparatus so as to be capable of communicating with the apparatus, and identification information identifying the image processing apparatus is received-from the apparatus. The computer system transmits a response to the image processing apparatus based upon the identification information received. Such an arrangement makes it possible to perform stricter control with regard to use of the image processing apparatus.

In the event of detection of a change in line information, inclusive of the received identification information, or if the addition of machine-related information is detected, this is registered in a state different from the ordinary. Accordingly, if the image processing apparatus has been moved, for example, thus resulting in a change in line information, it is possible to perform particularly strict management regarding this apparatus.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

FIG. 10 is a diagram showing an example of CNO signals.

DESCRIPTION QF THE PREFERRED EMBODIMENTS$

A preferred embodiment of the present invention will now be described in detail with reference to the accompanying drawings.

Though an example of a full-color copier is illustrated as an application of the present invention, it goes without saying that the invention is applicable also to monochromatic copiers and multiple-color copiers, as well as to devices other than copiers.

FIRST EMBODIMENT

Figure 3:
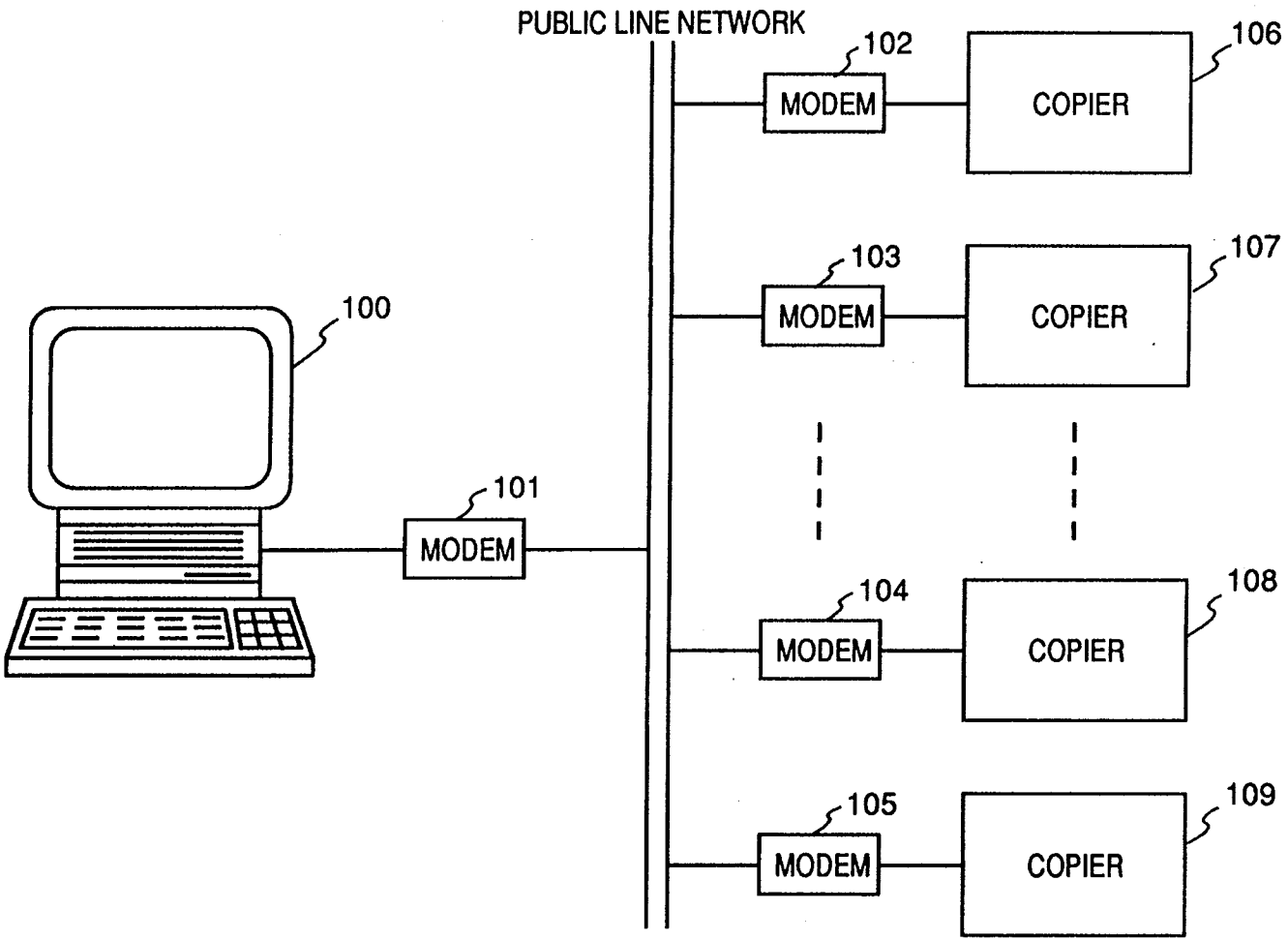
FIG. 3 is a diagram showing the general features of a system using the first embodiment.

FIG. 3 illustrates the general features of a system using the first embodiment of the invention.

As shown in FIG. 3, the system includes a computer used at a service location and connected to a public line network via a modem 101. Copiers 106~109 are connected to the public line network via modems 102~105, respectively. The computer 100 and copiers 106~109 are capable of being connected from both the computer side and copier side and can communicate with each other.

A specific embodiment realized by a full-color copier will now be described.

General View of the Apparatus

Figure 2:
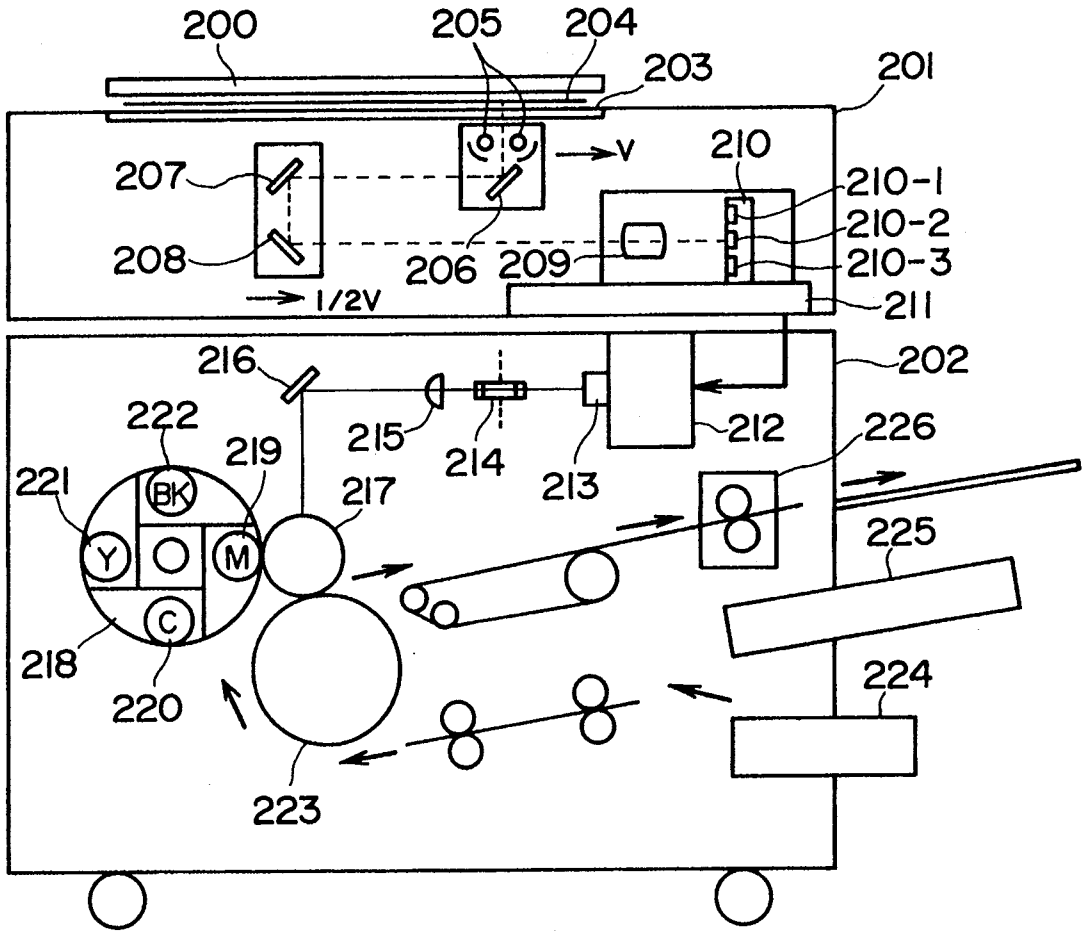
FIG. 2 is a general view of a color copier according to the first embodiment.

An overview of a color copier according to a first embodiment of the invention is shown in FIG. 2.

In FIG. 2, numeral 201 denotes an image scanning section for reading an original at a resolution of 400 dpi (dots/inch) and applying digital signal processing to the image data obtained by the reading operation. Numeral 202 designates a printing section for printing out an image, which corresponds to the original image read by the scanning section 201, on recording paper in full color at the resolution of 400 dpi.

The image scanning section 201 includes a pressure plate 200 having a mirror surface. An original 204 on a glass platen 203 is irradiated by means of lamps 205, reflected light obtained by irradiation of the original 204 is introduced to mirrors 206, 207, 208, and an image is formed on a three-line sensor (hereinafter referred to as a "CCD") 210 by a lens 209. The CCD 210 splits the full-color information into the components red (R), green (G) and blue (B) and sends these components to a signal processor 211. The entire surface of the original is scanned by mechanically moving the lamps 205 and mirror 206 at a velocity v as well as the mirrors 207, 208 at a velocity $\frac{1}{2}$ v in a direction (sub-scan direction) perpendicular to the electrical scanning direction (main-scan direction) of the line sensor.

The signal processor 211 electrically processes the read image signal, separates the signal into magenta (M), cyan (C), yellow (Y) and black (Bk) components and sends these components to the printing section 202. At least one component among the M, C, Y, Bk components is sent to the printing section 202 per scan of the original in the image scanning section 201, and a single print-out is completed by a total of four scans of the original.

The M, C, Y, Bk image signals received from the image scanning section 201 are sent to a laser driver 212. The laser driver 212 modulates and drives a semiconductor laser 213 in dependence upon the particular image signal sent. The laser light is made to scan across a photosensitive drum 217 via a polygon mirror 214, an f-$\theta$ lens 215 and a mirror 216.

Numeral 218 denotes a revolving developer comprising a magenta developing section 219, a cyan developing section 220, a yellow developing section 221 and a black developing section 222. These four developers come into alternate contact with the photosensitive drum 217 so that an electrostatic latent image formed on the photosensitive drum 217 is developed by means of toners.

Numeral 223 denotes a transfer drum upon which paper fed from a paper cassette 224 or 225 is wound so that the image developed on the photosensitive drum 217 may be transferred to the paper.

After the four colors M, C, Y, Bk have thus been transferred successively, the paper is passed through a fixing unit 226 tO fix the toners on the paper, after which the paper is ejected.

Image Scanner

Figure 1:
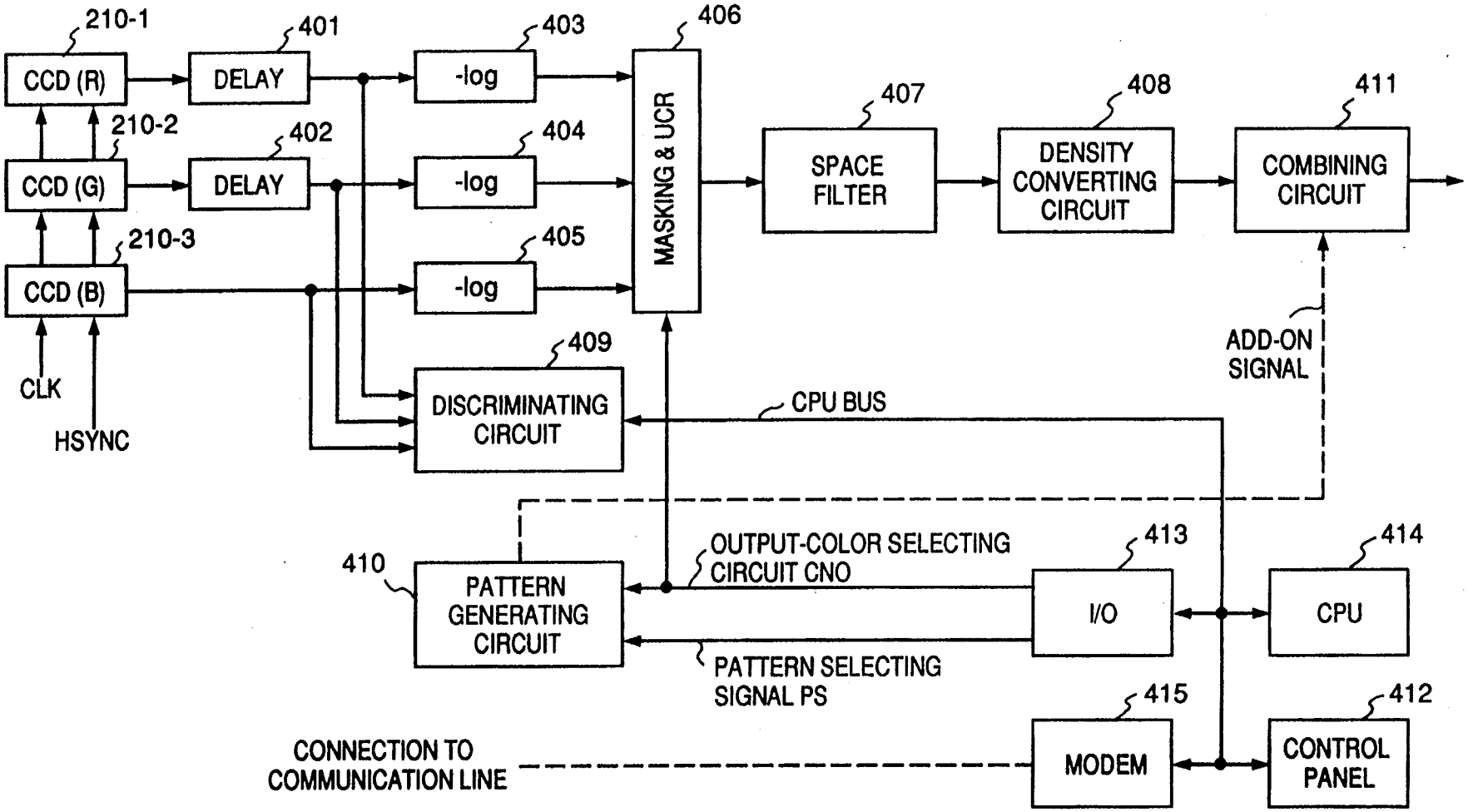
FIG. 1 is a block diagram illustrating an image scanner according to a first embodiment of the present invention.

FIG. 1 is a block diagram showing the construction of an image scanning section 201 according to the first embodiment of the present invention.

Numerals 210-1, 210-2, 210-3 in FIG. 1 denote CCD (solid-state image sensing device) line sensors having spectral sensitivity characteristics for red (R), green (G) and blue (B), respectively. Each item of R, G, B analog signals is subjected to an A/D conversion, after which it is outputted as an eight-bit (0~255) digital signal.

The sensors 210-1, 210-2, 210-3 used in the present embodiment are arranged so as to be spaced apart a fixed distance, and therefore a displacement in terms of time is corrected for using delay elements 401 and 402.

Numerals 403, 404, 405 are log converters constituted by a look-up table ROM or RAM for converting a luminance signal into a density signal. Numeral 406 denotes a well-known masking & UCR (undercolor removal) circuit. Though a detailed description is deleted, each of the magenta (M), cyan (C), yellow (Y) and black (Bk) signals for output are generated at a prescribed bit length (e.g., eight bits) in field-sequential fashion, based upon the three input signals inputted to the circuit 406, whenever there is a reading operation, Numeral 407 denotes a well-known space filter circuit which corrects the space-frequency of the output signal from the circuit 406. Numeral 408 denotes a density converting circuit for correcting the output signal in conformity with the density characteristic possessed by the printer 202. Like the log converters 403~405, this circuit is constituted by a ROM or RAM.

Numeral 411 denotes a circuit for combining an image signal (an add-on signal) outputted by a pattern generating circuit 410 and the image signal outputted by the masking/UCR circuit 406.

Numeral 414 denotes a microcomputer (hereinafter referred to as a "CPU") for supervising control of the apparatus, and numeral 413 denotes an input/output port (hereinafter referred to as an "I/O port") connected to the CPU 414.

A CNO signal is a two-bit output-color selecting signal. This is a control signal which indicates the order of the four reading operations, as shown in FIG. 10. The CNO signal is outputted from the CPU 414 via an I/O port 413. The operating conditions of the masking-UCR circuit 406 and the color pattern outputted by the pattern generating circuit 410 are changed over by the CNO signal.

Discriminating Circuit 409

A discriminating circuit 409 is a circuit which, based upon the read RGB data indicative of the original, discriminates an original the copying whereof is not allowed.

Though there are a variety of algorithms that can be used for discrimination, a technique effective for use in color copiers involves storing beforehand, as data, a color-distribution pattern or edge information indicative of an original that must not be copied, comparing this data with entered RGB image data on a real-time basis and not allowing copying if there is some degree of agreement between the items of compared data.

When it has been decided that copying is not allowed, the copying operation is forcibly terminated so that a copy output will not be produced. Another method is to paint a copy output in a specific color when it has been decided that copying is not allowed, thereby invalidating the output.

Pattern Generating Circuit 410

The pattern generating circuit 410 generates add-on image information in such a manner as to enable recording of, say, an ID number of the apparatus when a copy is made. The mark such as the encoded ID number is so recorded on the copy as not to be highly conspicuous.

By way of example, the information such as the ID number may be put into the form of a symbolic code such as a bar code on a location of the glass platen 203 outside the area on which the original is placed, and the information may be read and decoded when the apparatus is turned on or when a copying operation starts. Another method is to enter the information via a control panel 412 and store the information in a backup memory so that the information may be used.

When an image is recorded in yellow toner, which is comparatively inconspicuous, recording is performed upon replacing the ID-number information by information having a slightly different shade. In a case where the apparatus is specified from the recorded information at a later date, a reverse conversion of information is performed in such a manner that the shading information is made conspicuous using a color filter.

In this embodiment, the pattern generating circuit 410 converts the ID number, which has been written in, into shading information via a pattern-select signal PS, thereby obtaining image information, and generates this image information solely as a yellow image (using the output selection signal CNO).

Combining Circuit 411

The combining circuit 411, which combines the image information generated by the pattern generating circuit 410 and the image information read by the CCD 210, is constituted by an adding circuit for combining the shading information in the manner described above. When data is added, however, care must be taken to avoid overflow and underflow of data.

Control Panel 412

Figure 4:
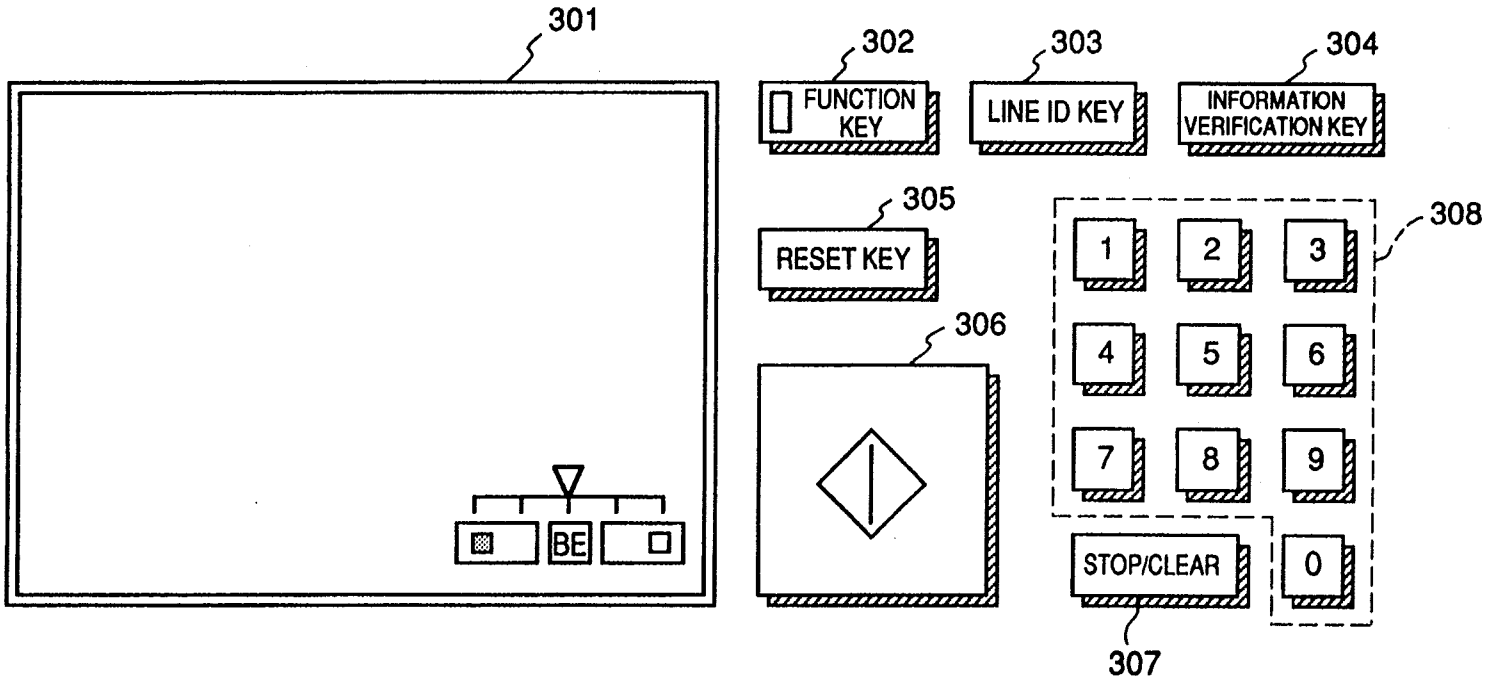
FIG. 4 is a diagram showing the specific configuration of a control panel.

FIG. 4 is a diagram showing a specific arrangement of the control panel 412.

Numeral 301 denotes a touch-panel display that employs a liquid-crystal display element capable of preventing a color display. This makes it possible to display the number of copies and to adjust density using the touch panel, as shown in FIG. 4. In a case where the ID number of the apparatus is entered from the control panel 412, the entered ID number is displayed.

The control panel 412 has a function key 302 for selecting a color converting function or an add-on function such as masking or trimming. The key incorporates an internal LED (light-emitting diode) which lights when a function is selected.

A line ID key is for entering or changing a line ID. When the line ID key 303 is pressed, it is possible to enter or change the line ID. The line ID is changed by using a numeric key pad 308, a stop/clear key 307, etc. The line ID key 303 is used in a case where there is a change in the line ID, such as the telephone number, owing to a change in the location at which the apparatus is used.

An information verification key 304 is used when verifying information such as the ID number of the apparatus and the line ID. A reset key 305 is used when settings relating to various types of copying operations are returned to a standard state. A copy key 306 is used to designate the start of a copying operation. When a copying operation is to be suspended, a stop/clear key 307 is used. The latter is used also for clearing a numerical value such as the number of copies. The numeric key pad 308 is for entering numerical values such as line ID number, number of copies, etc.

Modem 415

The modem 415 is connected to a public line network. The apparatus communicates with a base system via the modem 415.

Flowcharts

Figure 5:
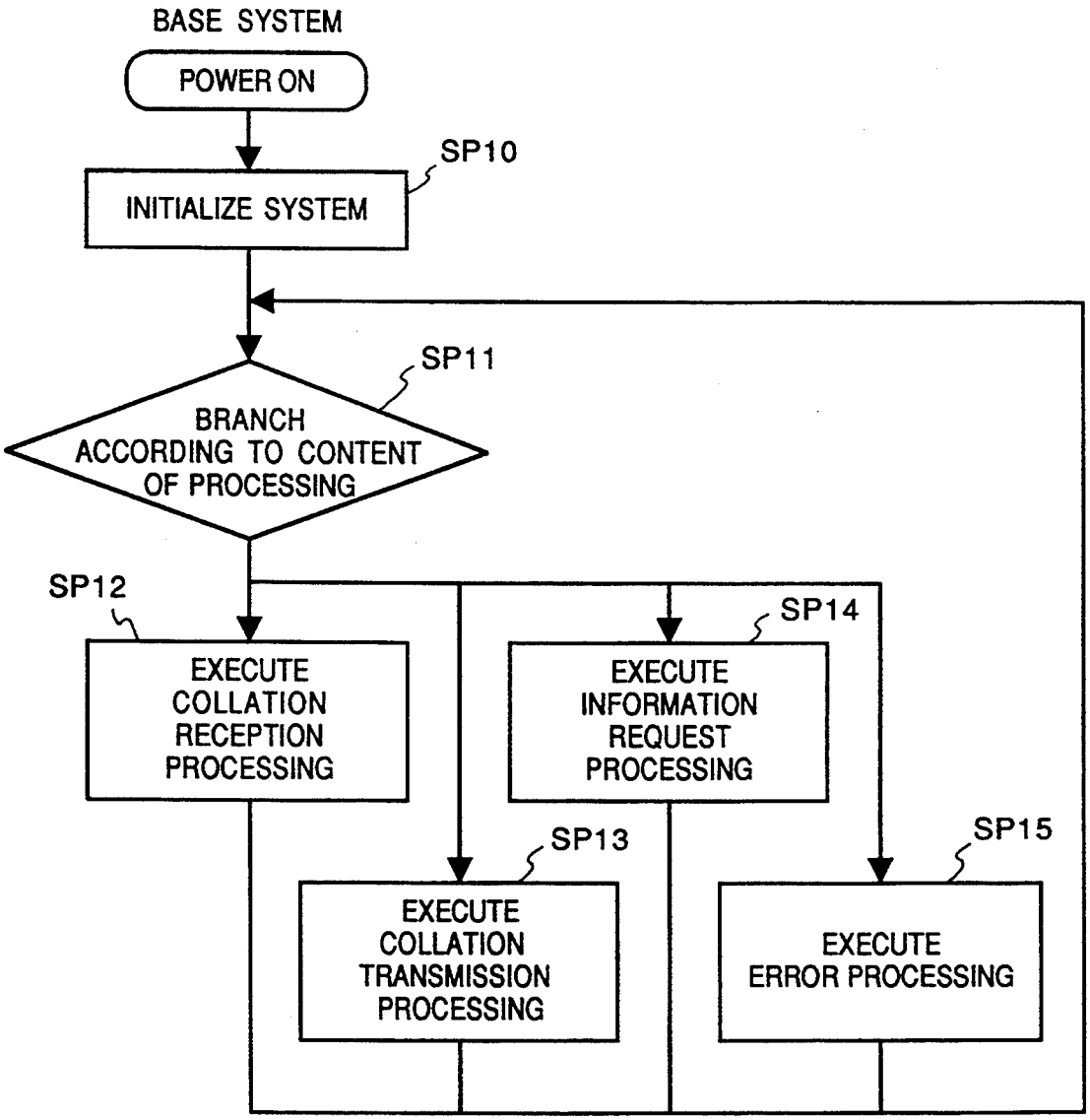
FIG. 5 is a flowchart for describing the operation executed by a base system.

An example of flowcharts of programs executed by the computer 100 of the base system will now be described with reference to FIGS. 5 through 7.

The flowchart of a main routine will now be described in accordance with FIG. 5.

When the computer 100 is started, the computer executes step SP10 first to initialize the computer system.

Next, the computer proceeds to step SP11, at which the program branches to step SP12, SP13, SP14 or SP15 depending upon the processing required. If no processing is necessary, the computer waits in an idle mode at step SP11.

Step SP12 is a processing routine (collation reception processing) for accepting collation from the copier connected to the computer via a public line network. More specifically, the computer 100 processes a collation-start request from the copier side when a plug of the copier is connected to an outlet or when a main switch is closed.

Step SP13 is a processing routine (collation transmission processing) for executing collation based upon the collation data received at step SP12. Specifically, this step is for communicating verification from the computer to the copier.

Step SP14 is a processing routine (information request processing) through which the computer 100 actuates each copier to collect information such as billing information for the number of copies, etc. This processing is started as by using the keyboard of the computer 100.

Step SP15 is a processing routine through which each copier actuates the computer 100 in order that information such as an error generated on the copier side may be accepted, or through which an error generated in collation reception processing (SP12) or collation transmission processing (SP13) is processed. This processing is initiated when the computer 100, which constantly monitors the modem 101, detects the state that there is no job to be executed, or in response to the status of an internal error flag. In the case where error information has been accepted, the operator is alerted and processing is executed simultaneously to access the computer 100 and take the necessary measures promptly.

The details of the flowchart for the verification reception processing of step SP12 will now be described with reference to FIG. 6.

The machine ID sent from the copier and the line ID are received at step SP100. Next, it is determined at step SP101 whether the machine ID has already been recorded. The program branches depending upon the decision.

In the case of a new machine ID that has not been registered, the program branches to step SP103, at which the ID is registered anew as data in the computer 100. In this case, the data should be retained for special treatment until it is clarified that the copier is legal and has merely been moved or that the copier has been stolen.

In the case of an already registered machine ID, the program proceeds to step SP102, where collation is performed with regard to the previously registered line ID. The program branches depending upon the decision rendered. If matching is not achieved, a change is made at step SP104. Here the registration and alteration of the line ID are performed. Here also information relating to a newly registered ID or changed ID is set aside.

Information ±elating to the date and time is stored at step SP105 as historic data managed for each and every machine ID. Furthermore, a collation transmission flag is turned on. This is a flag for starting collation transmission processing. The program then proceeds to step SP106, at which the line is disconnected to end collation reception processing.

The details of the flowchart for the collation transmission processing of step SP13 will now be described with reference to FIG. 7.

Collation transmission processing is executed upon branching from step SP11 in response to the "ON" state of the collation transmission flag. This flag, which is the parameter for starting collation transmission processing described earlier, is turned off at step SP120 prior to processing.

A copier starts being accessed at step SP121 via the modem 101 using the registered line ID. It is then determined at steps SP122, 123 whether the line connection has been made normally. If an error has occurred more than a predetermined number of times, the program proceeds to step SP126. The program proceeds to step SP124 if the connection has been made normally.

Collation data is computed and the results transmitted at step SP124. The collation data is data for collation, by a predetermined method, between the base system and a copier to be subjected to management. This data is used in the event of some abnormality or to verify a copier not registered with the base system. The collation data ordinarily is saved upon being encrypted so that it cannot be understood even if seen.

The program branches at step SP125 based upon the results of collation. The collation data transmitted from computer 100 is collated in the copier and the results of collation are sent back to the computer 100. If an error has occurred, the program proceeds to step SP126, at which an error flag is turned on and the content of the data recorded. It should be noted that it is determined at step SP11 whether the error flag is on, with step SP15 being executed if the error flag is found to be on.

The line is disconnected at step SP127 and the processing routine for collation transmission is terminated.

An example of a flowchart of a program executed by the CPU 414 on the side of a copier will be described with reference to FIGS. 8 and 9. In the flowchart described below, the CPU 414 and modem 415 operate simultaneously from an outlet. It will be assumed that communication with the base system is possible, even if the main switch is off, so long as power is being supplied from an outlet.

Figure 8:
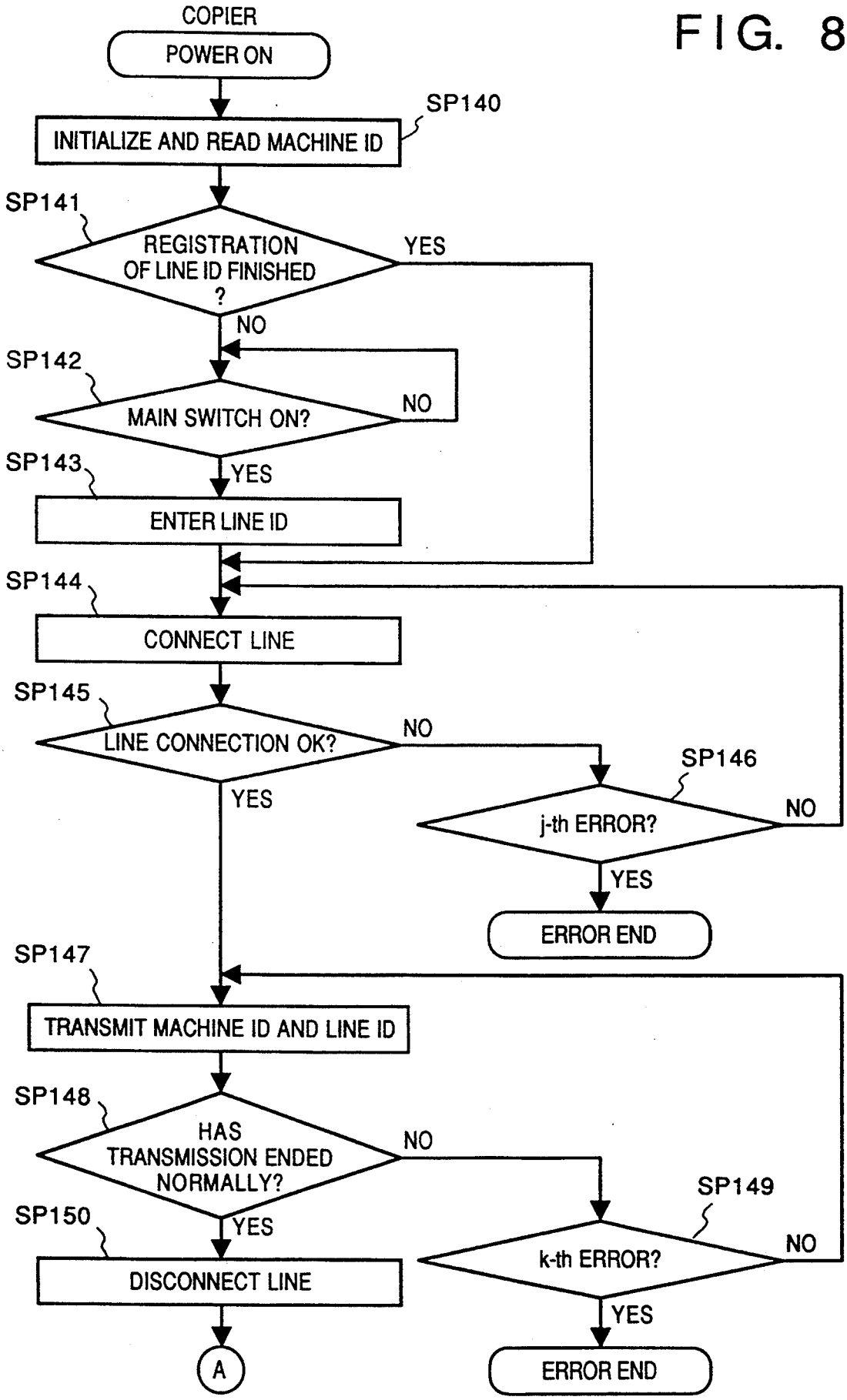
FIG. 8 is a flowchart for describing the operation performed by a CPU on the side of a copier.
Figure 9:
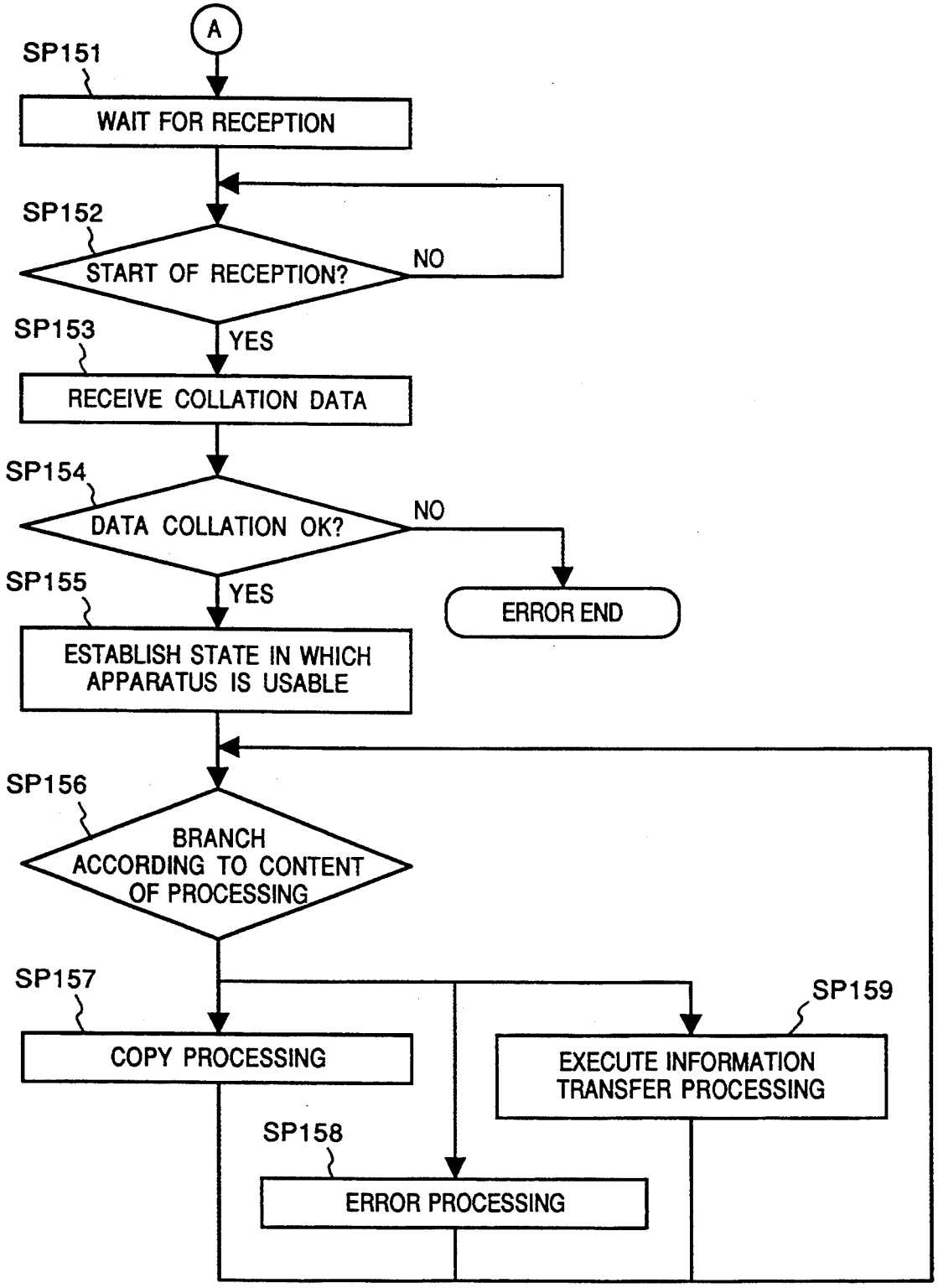
FIG. 9 is a flowchart for describing the operation performed by a CPU on the side of a copier.

In FIGS. 8 and 9, step SP140 is a routine for executing an initializing operation. If the machine ID has been entered in the apparatus, the machine ID is read at this step.

Step SP141 is a routine for determining whether the line ID used at the time of connection to the base system has already been registered. The program proceeds to step SP142 if the line ID has not yet been registered and to step SP144 if the line ID has been registered. It is determined at step SP142 whether the main switch of the copier has been closed. If it is determined that the main switch has been closed, then the program proceeds to step SP143, at which the line ID is entered from the control panel 412.

The line is connected at step SP144 in order to access the computer 100 at the base. Steps SP145, SP146 constitute a routine in which, if the line connection ends in failure, the line connection is attempted repeatedly a predetermined number of times and an error is generated if the line connection still cannot be achieved. When an error is discriminated, a display is presented on the control panel 412 and processing is terminated. In such case, the copier cannot be used.

The loop of steps SP147~SP149 is a routine for transmitting the machine ID and line ID data to the base. If the transmission cannot be performed normally, an error is discriminated and processing is terminated in the same manner as described above.

If the transmission ends normally, then the program proceeds to step SP150 and the line is disconnected. A transition is then made to a reception standby state at step SP151 and communication from the base is awaited at step SP152.

If reception has started, the program proceeds to step SP153, at which the transmitted collation data is received. It is determined at step SP154 whether agreement with internal collation data has been achieved, and the program branches depending upon the result of this determination. Processing ends in an error if agreement is not obtained. If agreement is obtained, then the program proceeds to step SP155, at which the copier is placed in a state in which it is capable of being used by the user. It should be noted that the result of judging the collation data is transmitted to the computer 100.

The steps SP157~SP159 constitute a processing routine for when the copier is capable of being used. Step SP157 is ordinary copy processing, and steps SP158, SP159 are processing steps corresponding to the steps SP15, SP14 executed by the computer 100.

In accordance with the first embodiment described above, it is possible to manage the apparatus inexpensively and effectively by improving the conventional management system that utilizes communication lines.

SECOND EMBODIMENT

In the first embodiment, the arrangement is such that the base system accepts new copiers that have not been registered. However, since a case in which a copier is newly registered may be one in which the copier is moved and connected upon being stolen, the following arrangement can be adopted as a countermeasure for such a situation.

Figure 6:
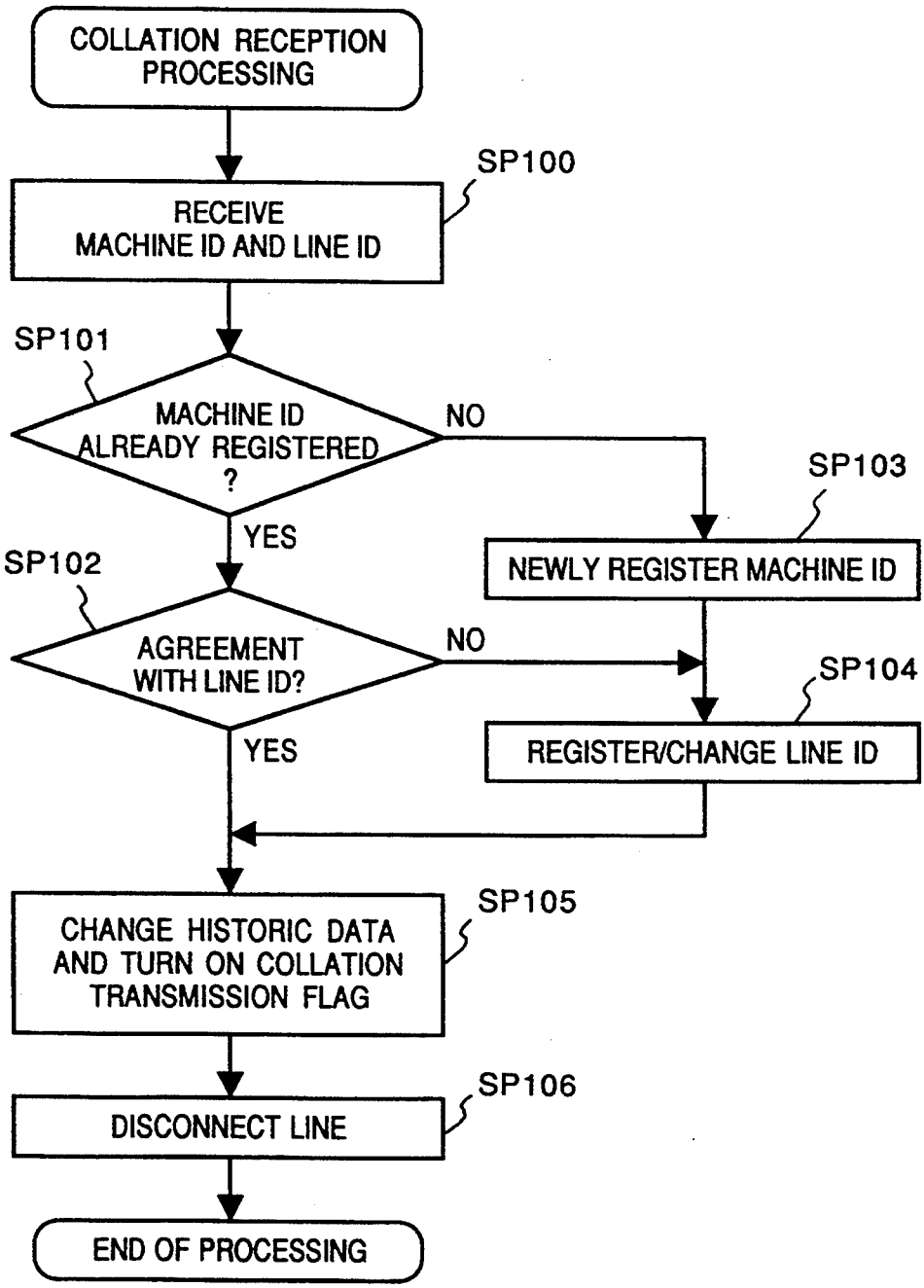
FIG. 6 is a flowchart for describing the operation executed by a base system.
Figure 7:
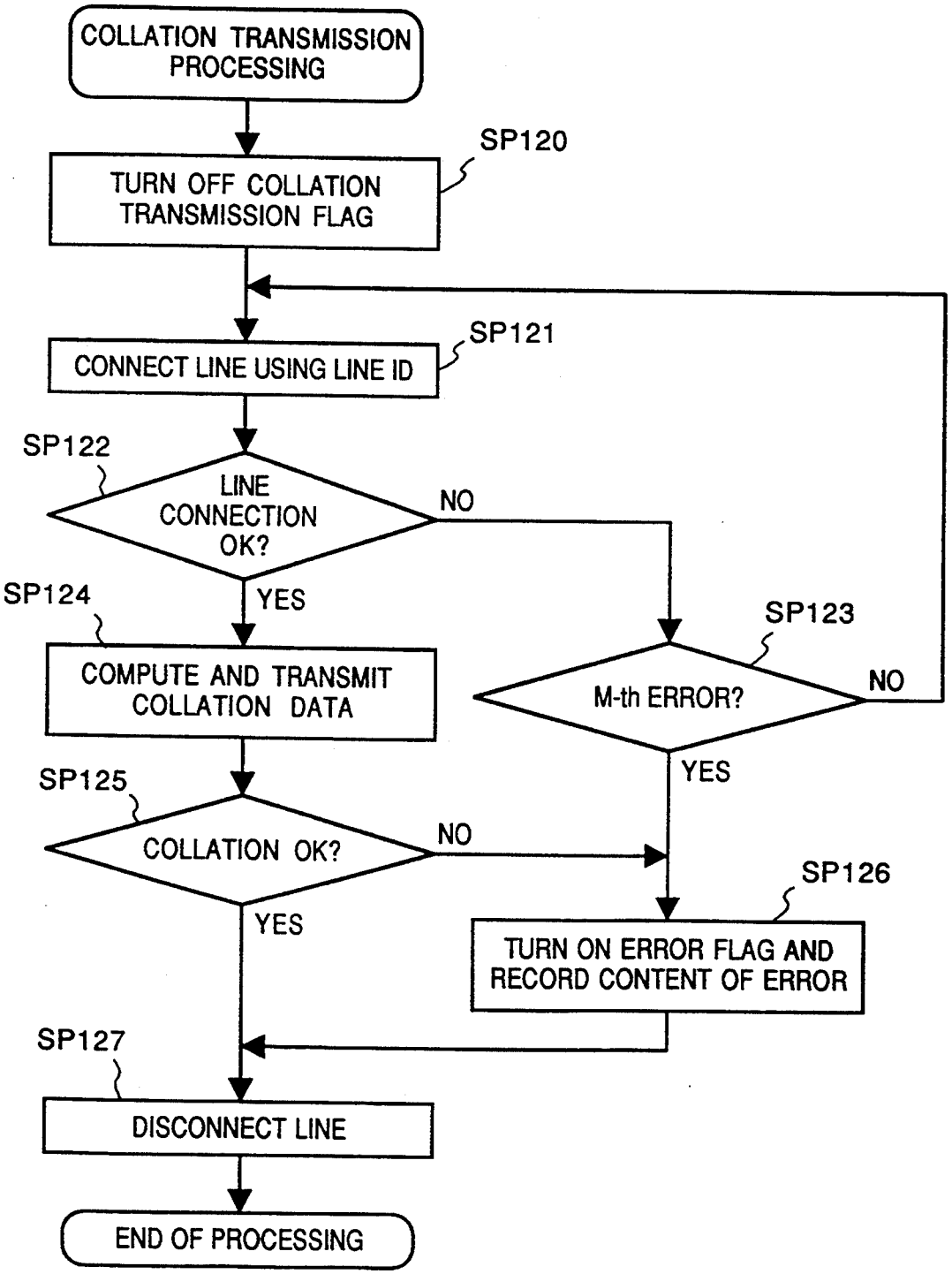
FIG. 7 is a flowchart for describing the operation executed by a base system.

In a case where a NO decision is rendered at step SP101 in FIG. 6, a warning can be displayed on the display unit of the base computer and additional information such as that indicative of new registration can be added to data indicative of the history of communication with each copier, after which this additional information can be retrieved with ease. By adopting this arrangement, it is possible to prepare for a case in which a copier is used illegally (for example, forgery of securities), in which case suitable measures can be promptly taken. In a case where an operating method is adopted in which management of a copier is registered with the base computer beforehand, such new registration will allow more effective management of the copiers since it will be possible to predict that there are special circumstances. In addition, since the extent of management of the apparatus can readily be changed through software, it is possible to deal with each apparatus in a highly flexible manner. For example, in the case of a full-color copier, line ID and machine ID can be strictly managed. For a multiple-color copier, on the other hand, it will suffice to register the machine ID.

THIRD EMBODIMENT

If a NO decision is rendered at step SP102 in FIG. 6 of the first embodiment, i.e., if the line ID is found to be different from that already registered, a warning can be displayed on the display unit of the base computer and additional information such as that indicative of new registration can be added to data indicative of the history of communication with each copier, after which this additional information can be retrieved with ease, just as in the second embodiment described above. If the method of managing copiers adopted in this case is such that it is necessary to establish contact in advance when a line ID is to be changed, the change will be construed as being an abnormality. As a result, effects similar to those of the second embodiment can be obtained.

FOURTH EMBODIMENT

In the first embodiment, a judgment is made with regard to the agreement of collation data. However, the following arrangement can be adopted utilizing the results from a discriminating circuit for preventing counterfeiting or the information from a personal ID card employed when the copier is used:

For example, if the discriminating circuit 409 generates an error and the CPU 414 senses this error, the collation data is intentionally altered and it is arranged so that the copier cannot be used.

Further, an arrangement may be adopted in which information from the personal ID card is added to the collation data to restrict use of the copier solely to registered individuals. In this case, it is desired that it be possible to register plural items of collation data.

The effects obtained from each of the foregoing embodiments are summarized below.

Information (e.g., a telephone number) specifying the location at which a device such as a copier is installed and information (the machine number, etc. ) identifying the device itself is transmitted from the device to the system at the base. On the base side, the device is accessed based upon the information transmitted. On the side of the device, use of the device is restricted at least until the base can be accessed. In a case where management is to be reinforced, use of the device per se is restricted until a response is received from the base.

By adopting this arrangement, the location at which a device is installed is specified more reliably at the base by means of the line ID. Even if a crime using the device has been committed, it is possible, in combination with a technique for specifying the number of the machine used in the crime, to specify the suspect, the location, etc.

Further, in a case where use of the device per se is restricted until a response is received from the base, when the device has been stolen the device cannot be used unless information such as the line ID specifying the place of installation is changed. Accordingly, if the device is stolen it cannot be used. This is useful in preventing crime.

Further, even if information specifying the place of installation is changed at a location to which the device has been moved (i.e., changed to the line ID of the new location), it is possible to ascertain the place of use and the machine-related information from the information specifying the place of installation. This provides effects superior to those obtained with the conventional management method.

Thus, in accordance with the present invention as described above, it is possible to manage an apparatus inexpensively and effectively by improving the conventional management system that utilizes communication lines.

The present invention can be applied to a system constituted by a plurality of devices or to an apparatus comprising a single device. Furthermore, it goes without saying that the invention is applicable also to a case where the object of the invention is attained by supplying a program to a system or apparatus.

As many apparently widely different embodiments of the present invention can be made without departing from the spirit and scope thereof, it is to be understood that the invention is not limited to the specific embodiments thereof except as defined in the appended claims.

What is claimed is:

1. An image processing apparatus comprising:

transmitting means for transmitting line information of the image processing apparatus to an external device;

receiving means for receiving a response from the external device, which is initiated by the external device based upon the transmitted line information; and restricting means for restricting use of at least some functions of said image processing apparatus until the response is received by said receiving means.

2. The apparatus according to claim 1, wherein said transmitting means transmits said line information to the external device using a communication line, and said receiving means receives said response from the external device via said communication line.

3. The apparatus according to claim 1, further comprising disconnecting means for disconnecting a line used by the transmitting means.

4. An image processing apparatus comprising:

transmitting means for transmitting location information of the image processing apparatus to an external device;

receiving means for receiving a response from the external device which is initiated by the external device based upon the transmitted location information; and restricting means for controlling use of functions of said image processing apparatus based upon contents of the response.

5. The apparatus according to claim 4, wherein said response includes collation data for performing collation with the external device;

said apparatus further comprising decision means for determining whether the collation data is normal or not;

said restricting means restricting use of at least some functions of said image processing apparatus if the collation data is abnormal.

6. The apparatus according to claim 4, further comprising executing means for executing said transmitting means when power has been supplied to said image processing apparatus via a power-supply plug.

7. The apparatus according to claim 4, wherein the function of the image processing apparatus is restricted till said response is received.

8. The apparatus according to claim 4, further comprising disconnecting means for disconnecting a line used by the transmitting means.

9. A computer system connected, via a line, to at least one image processing apparatus for communicating with said at least one image processing apparatus, comprising:

receiving means for receiving line, which identifies said image processing from said at least one image processing apparatus via the line;

disconnecting means for disconnecting the line after receiving the line information by said receiving means; and responding means for connecting the line disconnected by said disconnecting means and transmitting a response to said image processing apparatus via the line based upon the line information received by said receiving means.

10. A computer system connected to at least one image processing apparatus via a communication line, comprising:

receiving means for receiving identifying information, which includes line information of said image processing apparatus, from said image processing apparatus via said communication line;

line connecting means for connecting said communication line to said image processing apparatus by using the line information received by said receiving means; and responding means for responding to reception of the identifying information via the line connected by said line connecting means.

11. The computer system according to claim 10, further comprising memory means which, when connection of a communication line by said line connecting means has ended in failure, stores information to this effect in correspondence with the identifying information.

12. The computer system according to claim 10, further comprising:

registering means for registering an image processing apparatus specified by the identifying information received by said receiving means;

decision means for determining whether the image processing apparatus specified by the identifying information received by said receiving means has already been registered in said registering means; and memory means which, when said decision means has determined that the image processing apparatus has not been registered, is for registering said image processing apparatus by said registering means and storing an indication to the effect that registration has been performed anew.

13. The computer system according to claim 12, wherein said identifying information includes machine information specifying the image processing apparatus, and line information for performing a line connection to said image processing apparatus;

said registering means for registering, in a pair, machine information and line information from the identifying information received in the past by said receiving means;

said decision means determining whether a combination of received machine information and line information agrees with a pair registered by said registering means;

wherein when said decision means determines that agreement has not been achieved, said memory means stores an indication to this effect.

14. The computer system according to claim 10, wherein said responding means transmits collation information for performing collation, through a predetermined method, with a connected image processing apparatus;

further comprising memory means for storing results of collation of said collation data in said image processing apparatus.

15. A method of restricting functions of an image processing apparatus, comprising:

a transmitting step of transmitting line information of the image processing apparatus to an external device;

a receiving step of receiving a response from the external device during a communication initiated by the external device based upon the transmitted line information; and a restricting step of restricting use of at least some functions of said image processing apparatus until the response is received.

16. A method of restricting functions of an image processing apparatus, comprising:

a transmitting step of transmitting location information of the image processing apparatus to an external device;

a receiving step of receiving a response from the external device during a communication initiated by the external device based upon the location information; and a restricting step of controlling use of functions of said image processing apparatus based upon contents of the response.

17. A communication method in a computer system connected, via a line, to at least one image processing apparatus for communicating with said at least one image processing apparatus, comprising:

a receiving step of receiving line information said at least one image processing apparatus;

a disconnecting step of disconnecting the line after receiving the line information in said receiving step; and a responding step of connecting the line disconnected in said disconnecting step and transmitting a response to said at least one image processing apparatus via the line based upon the line information received at said receiving step.

18. A communication method in a computer system connected to at least one image processing apparatus so as to be capable of communicating with said image processing apparatus, comprising:

a receiving step of receiving identifying information, which includes line information of said image processing apparatus, from said image processing apparatus via said communication line;

a line connecting step of connecting said communication line to said image processing apparatus by using the line information received at said receiving step; and a responding step of responding to reception of the identifying information via the communication line connected at said line connecting step.

19. A management system in which at least one image processing apparatus is connected, via a line, to at least one host device, comprising:

first transmitting means for transmitting line information of the image processing apparatus from the at least one image processing apparatus to the host device via the line;

disconnecting means for disconnecting the line after completing transmission from the first transmitting means;

connecting means for connecting the line by the host device based on the line information received from the at least one image processing apparatus;

second transmitting means for transmitting a response from the host device to the at least one image processing apparatus via the line; and restricting means for restricting at least some functions of the at least one image processing apparatus until the response is received by the at least one image processing apparatus.

* * * * *

UNITED STATES PATENT AND TRADEMARK OFFICE

CERTIFICATE OF CORRECTION

PATENT NO. : 5,444,517

DATED : August 22, 1995

INVENTOR : NAO NAGASHIMA

It is certified that error appears in the above-identified patent and that said Letters Patent is hereby corrected as shown below:

COLUMN 1

Line 62, "limited restricted" should read --limited/restricted--.

COLUMN 2

Line 3, "received-from" should read --received from--.

COLUMN 11

Line 3, "line, which identifies" should read --line information--; and
Line 4, "said image processing" should be deleted.

COLUMN 12

Line 34, "said" should read --from said--.

Signed and Sealed this

Twenty-sixth Day of December, 1995

*Attest:*

Bruce Lehman

BRUCE LEHMAN

*Attesting Officer*

*Commissioner of Patents and Trademarks*